US007740212B2

(12) United States Patent
Austin et al.

(10) Patent No.: US 7,740,212 B2
(45) Date of Patent: Jun. 22, 2010

(54) APPARATUS TO RETAIN AND POSITION TUBING OF MEDIA BAGS

(75) Inventors: James Austin, Fort Worth, TX (US); Anthony Cox, Hurst, TX (US); James Hobson, Burleson, TX (US)

(73) Assignee: ConeCraft, Inc., Fort Worth, TX (US)

( * ) Notice: Subject to any disclaimer, the term of this patent is extended or adjusted under 35 U.S.C. 154(b) by 95 days.

(21) Appl. No.: 12/148,211

(22) Filed: Apr. 17, 2008

(65) Prior Publication Data

US 2010/0065710 A1 Mar. 18, 2010

(51) Int. Cl.
*B65B 67/12* (2006.01)

(52) U.S. Cl. ..... 248/95; 248/65; 383/2

(58) Field of Classification Search ..... 248/544, 248/56, 300, 95; 600/102; 604/80, 258; 128/DIG. 26, DIG. 6; 222/145.1, 1, 132, 222/136, 145.7; 53/425, 426, 428, 11 R, 53/469; 383/2

See application file for complete search history.

(56) References Cited

U.S. PATENT DOCUMENTS

| | | | |
|---|---|---|---|
| 301,753 | A | 7/1884 | Porter et al. |
| 508,408 | A | 11/1893 | Cogswell |
| 797,215 | A | 8/1905 | Osborne et al. |
| 901,034 | A | 10/1908 | Patterson |
| 935,076 | A | 9/1909 | Wemhoff |
| 1,118,738 | A | 11/1914 | Carroll |
| 1,272,222 | A | 7/1918 | Clayton |
| 2,315,365 | A | 3/1943 | Christy |
| 2,579,685 | A | 12/1951 | Loose |
| 2,649,991 | A | 8/1953 | Woock |
| 2,720,998 | A | 10/1955 | Potter |
| 2,805,793 | A | 9/1957 | Crisafulli |
| 2,826,329 | A | 3/1958 | Beckner |
| 2,894,666 | A | 7/1959 | Campbell, Jr. |
| 2,916,161 | A | 12/1959 | Schaefer |
| 2,973,119 | A | 2/1961 | O'C Parker |
| 3,105,617 | A | 10/1963 | Fredrik |
| 3,212,681 | A | 10/1965 | Weikert |
| 3,343,719 | A | 9/1967 | Kastamo et al. |

(Continued)

FOREIGN PATENT DOCUMENTS

| | | | |
|---|---|---|---|
| DE | 4039836 | A1 | 6/1992 |

(Continued)

OTHER PUBLICATIONS

*The Flexel 3-D System*, Stedim, Inc., 1998.

(Continued)

*Primary Examiner*—Korie Chan
(74) *Attorney, Agent, or Firm*—Workman Nydegger

(57) ABSTRACT

An apparatus to retain and position tubing of media bags with a bottom gate made of a single piece, with features to hold and retain media bag tubing, a recessed structure where the bottom gate is positioned when installed that places the top of the gate flush with the inside surface of the media bag holder, and locking tabs on the inside surface of the media bag holder that prevent the bottom gate from lifting and allow it to be installed in only the correct orientation.

19 Claims, 3 Drawing Sheets

U.S. PATENT DOCUMENTS

| | | | | | |
|---|---|---|---|---|---|
| 3,481,511 | A | | 12/1969 | Metke | |
| 3,552,577 | A | * | 1/1971 | Latham, Jr. | 211/74 |
| 3,735,898 | A | | 5/1973 | Smith | |
| 3,874,569 | A | | 4/1975 | Fossett et al. | |
| 3,908,864 | A | | 9/1975 | Capper | |
| 3,960,294 | A | | 6/1976 | Bernard | |
| 4,119,263 | A | | 10/1978 | Cuthbertson et al. | |
| 4,164,964 | A | * | 8/1979 | Daniels | 141/329 |
| 4,271,987 | A | | 6/1981 | Eriksson et al. | |
| 4,280,401 | A | * | 7/1981 | Cleland | 99/295 |
| 4,356,937 | A | | 11/1982 | Simon et al. | |
| 4,390,051 | A | | 6/1983 | Cuthbertson | |
| 4,591,065 | A | | 5/1986 | Foy | |
| 4,654,026 | A | * | 3/1987 | Underwood | 604/80 |
| 4,666,064 | A | | 5/1987 | Hoehn | |
| 4,817,824 | A | | 4/1989 | LaFleur et al. | |
| 4,883,201 | A | | 11/1989 | Poulton | |
| 4,953,754 | A | | 9/1990 | Credle, Jr. | |
| 4,998,692 | A | * | 3/1991 | Shigeki et al. | 248/56 |
| 5,000,352 | A | | 3/1991 | Cleland | |
| 5,033,649 | A | | 7/1991 | Copeland et al. | |
| 5,207,642 | A | * | 5/1993 | Orkin et al. | 604/65 |
| 5,333,777 | A | | 8/1994 | Roth | |
| 5,383,576 | A | | 1/1995 | Richter et al. | |
| 5,402,915 | A | | 4/1995 | Hogan | |
| 5,531,352 | A | | 7/1996 | Kraft et al. | |
| 5,549,707 | A | | 8/1996 | Weaver | |
| 5,584,327 | A | | 12/1996 | Thomas et al. | |
| 5,673,817 | A | | 10/1997 | Mullen et al. | |
| 5,810,204 | A | | 9/1998 | Devlin et al. | |
| 5,873,498 | A | | 2/1999 | Moore et al. | |
| 5,881,535 | A | * | 3/1999 | Gliniecki et al. | 53/410 |
| 5,897,012 | A | | 4/1999 | Sortwell | |
| 5,944,227 | A | | 8/1999 | Schroeder et al. | |
| 5,947,334 | A | | 9/1999 | Rudick et al. | |
| 5,988,422 | A | | 11/1999 | Vallot | |
| 6,076,457 | A | | 6/2000 | Vallot | |
| 6,186,932 | B1 | | 2/2001 | Vallot | |
| 6,202,708 | B1 | | 3/2001 | Bynum | |
| 6,223,903 | B1 | | 5/2001 | Mansouri | |
| 6,253,806 | B1 | | 7/2001 | Sperry et al. | |
| 6,286,700 | B1 | | 9/2001 | Davidson | |
| 6,302,299 | B1 | | 10/2001 | Baker et al. | |
| 6,345,734 | B2 | | 2/2002 | Schalow et al. | |
| 6,431,407 | B1 | * | 8/2002 | Hogan et al. | 222/278 |
| 6,543,495 | B2 | | 4/2003 | Hougland | |
| 6,634,783 | B2 | | 10/2003 | Baron | |
| 6,659,132 | B2 | | 12/2003 | Smith et al. | |
| 6,929,155 | B1 | | 8/2005 | Sayers | |
| 7,284,579 | B2 | | 10/2007 | Elgan et al. | |
| 2004/0027912 | A1 | | 2/2004 | Bibbo et al. | |
| 2004/0074922 | A1 | | 4/2004 | Bothor et al. | |
| 2004/0149766 | A1 | | 8/2004 | Karpisek | |
| 2005/0045639 | A1 | | 3/2005 | Thorpe | |
| 2007/0064519 | A1 | | 3/2007 | Neumann | |
| 2008/0017649 | A1 | | 1/2008 | Elgan et al. | |
| 2008/0110133 | A1 | * | 5/2008 | Lorenzi | 53/469 |
| 2008/0310768 | A1 | | 12/2008 | Hobson et al. | |

FOREIGN PATENT DOCUMENTS

| | | | |
|---|---|---|---|
| EP | 0072783 | A1 | 2/1983 |
| EP | 0586994 | A1 | 3/1994 |
| GB | 2069461 | A | 8/1981 |
| GB | 2078676 | A | 1/1982 |
| WO | WO 93/17930 | A1 | 9/1993 |

OTHER PUBLICATIONS

HyClone Configuration Packaging 50-200 Liter Drum Bottom Drain drawings, Dec. 2001.

* cited by examiner

APPARATUS TO RETAIN AND POSITION TUBING OF MEDIA BAGS

CROSS REFERENCE TO RELATED APPLICATIONS

Not Applicable.

STATEMENT REGARDING FEDERALLY SPONSORED RESEARCH OR DEVELOPMENT

Not Applicable.

DESCRIPTION OF ATTACHED APPENDIX

Not Applicable.

BACKGROUND OF THE INVENTION

1. Field of the Invention

This invention relates generally to the field of biopharmaceutical processing and more specifically to an apparatus to retain and position tubing of media bags.

2. The Relevant Technology

The biopharmaceutical industry has been increasingly using disposable media bags for product processing. The media bags, being filled with liquid, require a media bag holder to contain the filled media bag. The media bags may have a combination of top and bottom tubing in any quantity or configuration. The bottom tubing requires a means of passing through the bottom of the bag holder and being held in place. One prior method to accommodate media bag tubing is to provide fixed holes in the bottom of the bag holder with either no retaining device or simple clamping type devices in line with the holes underneath the bottom of the bag holder.

Another method is two moveable bottom pieces, each with one half of the required hole, which when brought together clamp onto the media bag tubing. Fixed holes in the bottom of the media bag holder allow for only one configuration of media bag tubing, both size of tubing and position. The clamping devices must be placed on the bottom of the bag holder which requires reaching underneath the bag holder, which may only be inches off the floor, making it difficult to see and access.

Two moveable bottom pieces do allow changing of pieces to accommodate various tubing configurations, but require locking devices which must also be placed on the bottom of the bag holder and are often difficult to see and access.

BRIEF SUMMARY OF THE INVENTION

One object of the invention is adaptability to multiple media bag configurations and quantities of tubing ports. One port to three or more ports being possible.

Another object of the invention is ease of installation and removal.

A further object of the invention is locking in place to prevent lifting of gate by movement of media bag without the need for retaining or clamping devices.

Another object of the invention is it can be made from various materials, such as, but not limited to, UHMW, Delrin, or even stainless steel.

Yet another object of the invention is being inexpensive to manufacture.

Still yet another object of the invention is alignment features that allow installation in only the correct orientation.

An additional object of the invention is the ability to provide a permanent indication of the correct direction of installation.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed an apparatus to retain and position tubing of media bags comprising: a bottom gate made of a single piece, with features to hold and retain media bag tubing, a recessed structure where the bottom gate is positioned when installed that places the top of the gate flush with the inside surface of the media bag holder, and locking tabs on the inside surface of the media bag holder that prevent the bottom gate from lifting and allow it to be installed in only the correct orientation.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
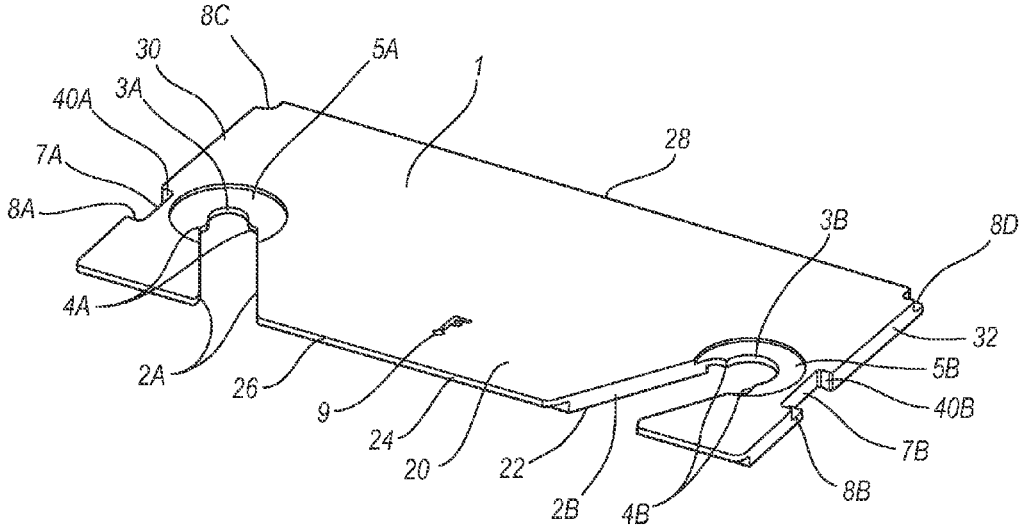
FIG. 1 is an isometric view of the bottom gate as viewed from above.

In accordance with the present invention, FIG. 1 shows a bottom gate 1 in the form of a plate having a top surface 20 and an opposing bottom surface 22 that both extend to an encircling perimeter edge 24. In the embodiment depicted, bottom gate 1 is rectangular so that perimeter edge 24 includes a front edge 26 and an opposing back edge 28 that both extend to opposing side edges 30 and 32. A pair of spaced apart slots 2A and 2B extend through bottom gate 1 from top surface 20 to bottom surface 22 and longitudinally extend from front edge 26 toward the interior of bottom gate 1. Each slot 2A and 2B terminates at an inwardly constricting neck opening 4A and 4B that accesses a hole 3A and 3B extending through bottom gate 1, respectively.

Figure 3:
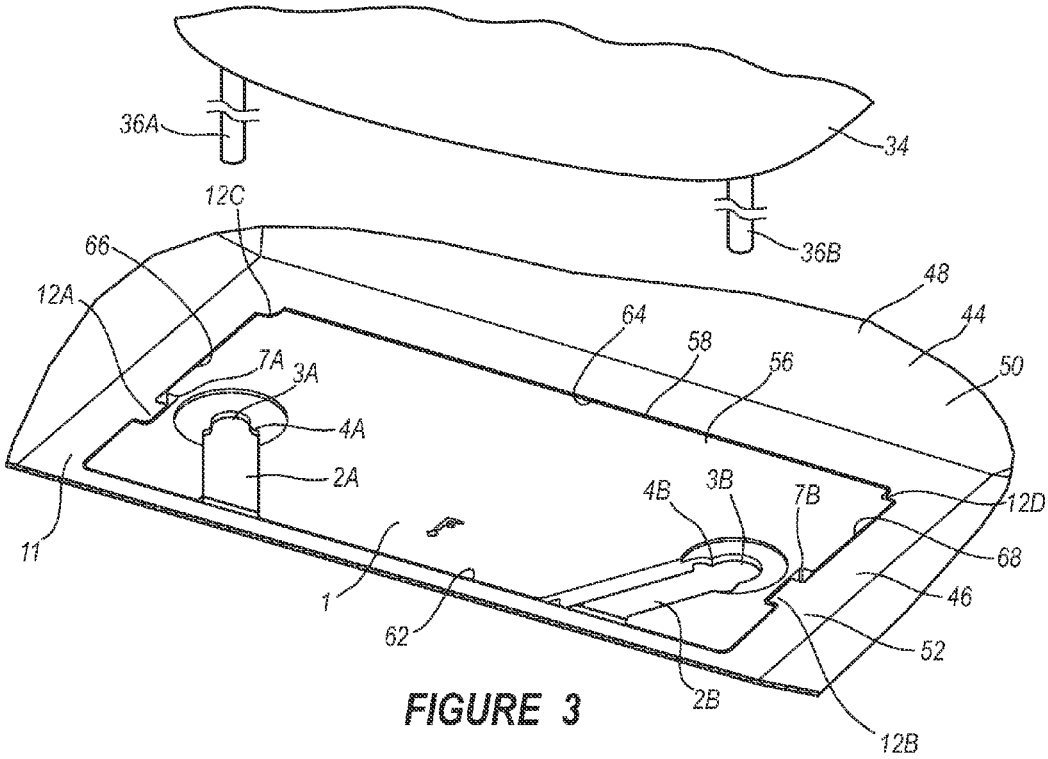
FIG. 3 is an isometric view of the bottom gate installed in a bag holder as viewed from above.

The slots 2A and 2B in the bottom gate 1 allow for passing tubing into the holes 3A, 3B in the bottom gate 1 that retain the tubing. For example, depicted in FIG. 3 is a media bag 34 having tubes 36A and 36B extending therefrom. Tube 36A can be received within hole 3A through slot 2A while tube 36B can be received within hole 3B through slot 2B. The slots 2A and 2B eliminate the need to feed long lengths of tubes 36A and 36B through holes 3A and 3B, and allow tubes 36A and 36B to approach the holes 3A and 3B radially.

Typically the media bags are made with fittings on the bottom of the bags to which the tubing is attached. The holes 3A and 3B are sized approximately the same as the outside diameter of the tubes 36A and 36B over this fitting, or only slightly larger for a clearance fit. The width of slots 2A and 2B may be considerably larger than the outside diameter of tubes 36A and 36B, but the necked openings 4A and 4B to the holes 3A and 3B are necked down, slightly smaller than the tubing outside diameter, allowing the tubes 36A and 36B to be snapped in place into the holes 3A and 3B, thereby retaining the tubes 3A and 3B.

Returning to FIG. 1, depending on the thickness of the material used for the bottom gate 1, top recesses 5A and 5B can be formed on top surface 20 about holes 3A and 3B, respectively, and bottom recesses 6A and 6B (FIG. 2) can be formed on bottom surface 22 about holes 3A and 3B, respectively. The recesses 5 and 6 may be provided to accommodate the section of the tubes to be snapped into place within the holes 3A and 3B. The top recesses 5A and 5B can also allow the fittings attached to the tubes to set down into the recesses, allowing the media bag to sit more flush with the surface. Additionally, the fittings in the media bag may neck down in diameter just near the surface of the media bag, allowing this necked down area to be the diameter that snaps into the holes 3A, 3B, eliminating any possibility of the tubes lifting out of the holes 3A, 3B.

Figure 4:
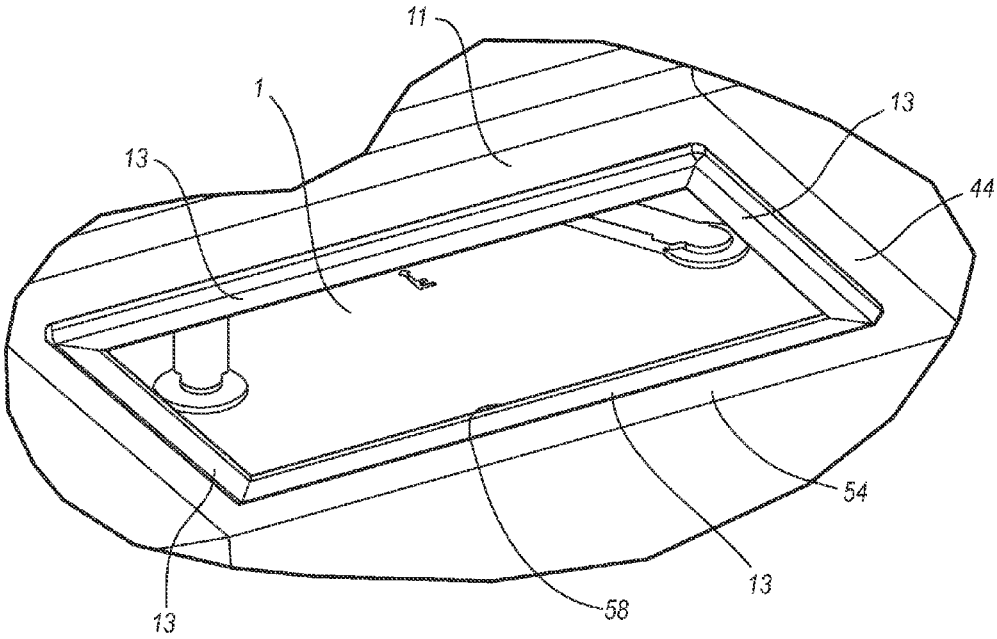
FIG. 4 is an isometric view of the bottom gate installed in a bag holder as viewed from below.

As also shown in FIG. 1, locking slots 7A and 7B are recessed on side edges 30 and 32, respectively, of bottom gate 1. Depicted in FIG. 3 is a media bag holder 44 having a floor 46 with a sidewall 48 upstanding therefrom and bounding a chamber 50. The floor 46 has a top surface 52 and an opposing bottom surface 54 (FIG. 4). Top surface 52 extends to an inside perimeter edge 56 that encircles an opening 58 extending through floor 46. Perimeter edge 56 is shown having a rectangular configuration that includes a front edge 62, an opposing back edge 64 and opposing sided edges 66 and 68 extending therebetween. Locking tabs 12A and 12B project from opposing side edges 66 and 68, respectively, into opening 58. As shown in FIG. 4, a support structure 13 is mounted on the bottom surface 54 and projects into the opening 58 at a location below top surface 52.

Returning to FIG. 3, locking slots 7A and 7B are formed on gate 1 so as to align with locking tabs 12A and 12B, respectively, on the opening 58 of the media bag holder 44. Returning to FIG. 1, each locking slot 7A and 7B is bounded by an inside edge 40A and 40B having a recessed feature 8A and 8B in the form of a stepped shoulder formed thereon, respectively. As shown in FIG. 3, each recessed feature 8A, 8B is configured to slide under locking tabs 12A and 12B on the opening 58 of the media bag holder 44, preventing the gate 1 from lifting when installed. FIG. 1 also shows a permanent feature 9 cut into top surface 20 of the gate 1 to indicate correct orientation of the gate 1 when installed.

FIG. 1 also shows recessed features 8C and 8D each in the form of a stepped shoulder formed on top surface 20 at the opposing ends of back edge 28. As shown in FIG. 3, floor 46 has locking tabs 12C and 12D formed at the opposing ends of back edge 64. Recessed features 8C and 8D are configured to slide under locking tabs 12C and 12D, respectively, when gate 1 is slid into opening 58.

Figure 2:
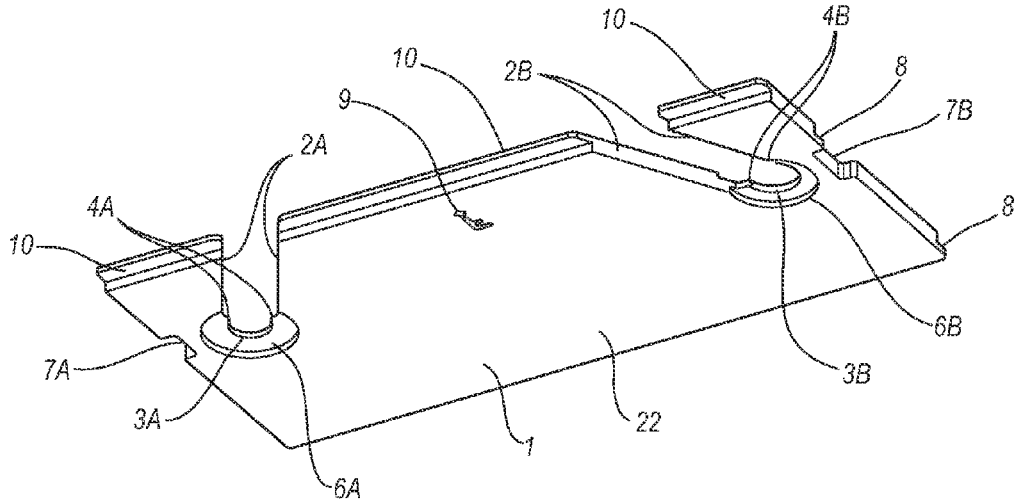
FIG. 2 is an isometric view of the bottom gate as viewed from bellow.

FIG. 2 shows gate 1 and the features thereof shown in FIG. 1 from an alternate perspective. Where the same elements are shown in each figure, the reference numbers are consistent. A material relief 10 is formed on the bottom surface 22 along the length of front edge 26 of the gate 1 that allows the gate 1 to be set in place on support structure 13 (FIG. 4) in the bottom of the media bag holder 44 and low enough in the bottom opening 58 to allow the gate 1 to then slide into place under locking tabs 12A and 12B in the opening 58 of the media bag holder 44. This feature allows the gate 1 to be just slightly smaller than the actual opening 58 in the media bag holder 44.

FIG. 3 shows the bottom gate 1 installed with top surface 20 thereof flush with the inside surface of 11 the media bag holder. The locking tabs 12A and 12B of media bag holder 44 correlate to the positions of the locking slots 7A and 7B in the gate 1. The locking tabs 12A and 12B on each side of opening 58 are different sizes, allowing the bottom gate 1 to be installed in only the correct orientation.

FIG. 4 shows the recessed support structure 13 where the bottom gate 1 is positioned when installed that places the top surface 20 of the gate 1 flush with the inside surface 11 of the media bag holder 44 (FIG. 3). The width and length of the opening 58 in the bottom of the media bag holder 44 are slightly larger than the dimensions of the bottom gate 1.

Media bags are delivered in a folded condition. With the media bag upside down, that is, the bottom tubing facing up, the bottom gate 1 may be installed onto the media bag by positioning the holes 3 in the bottom gate 1 onto the media bag tubing. The media bag and bottom gate 1 may then be placed together into the media bag holder 44. As they are placed into the media bag holder 44, the operator carefully positions the bottom gate 1 into the opening 58 in the bottom of the media bag holder 44 and slides gate 1 into the locking position where it cannot lift.

Alternatively, the bottom gate 1 may be placed into the media bag holder 44, and the folded bag then also placed into the media bag holder 44. The operator then lifts the bottom gate 1 just enough to pass the tubing through the opening 58 in the bottom of the media bag holder 44 and snap the tubing into place in the bottom gate 1.

Figure 5:
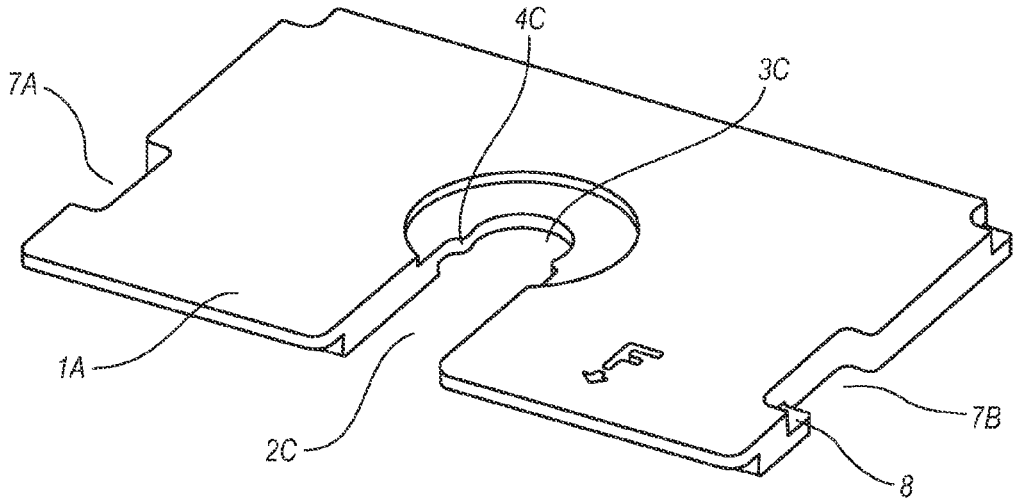
FIG. 5 is a drawing of a gate with a single position for a media bag with only one tubing port.

Depicted in FIG. 5 is an alternative embodiment of a bottom gate 1A having a single slot 2C that extends to a hole 3C through a necked opening 4C.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A media bag holder system comprising:

a media bag holder having a floor with a sidewall upstanding therefrom and bounding a chamber, the floor having a top surface and an opposing bottom surface, the top surface extending to an inside perimeter edge that encircles an opening extending through the floor, a support structure being mounted on the bottom surface of the floor and projecting into the opening at a location below the top surface of the floor; and a bottom gate comprising a plate having a top surface and an opposing bottom surface that both extend to an encircling outside perimeter edge, a passage extending through the plate from the top surface to the bottom surface, the plate being lowered down through the chamber and seated on the support structure so as to be disposed within the opening, the bottom gate being slidably movable on the support structure between an unlocked position wherein the bottom gate can be vertically lifted out of the opening so as to pass through the chamber of the media bag holder and a locked position wherein the gate is precluded from being vertically lifted out of the opening.

2. The media bag holder system as recited in claim 1, wherein the passage extending through the plate comprises an elongated slot extending from the outside perimeter edge of the plate toward an interior of the plate, the slot terminating at an inwardly tapered neck opening at the interior of the plate that access a hole extending through the plate.

3. The media bag holder system as recited in claim 1, wherein the top surface of the bottom gate is flush with top surface of the floor when the bottom gate is in the locked positioned within the opening.

4. The media bag holder system as recited in claim 1, further comprising:

two or more spaced apart locking slots recessed on the inside perimeter edge of the media bag holder or the outside perimeter edge of the bottom gate; and two or more locking tabs projecting from the other of the inside perimeter edge or the outside perimeter edge, the locking tabs being received within the locking slots.

5. The media bag holder system as recited in claim 4, further comprising a stepped shoulder formed on a portion of the bottom gate or media bag holder bounding one of the locking slots, the stepped shoulder being disposed below one of the locking tabs when the bottom gate is in the locked position.

6. The media bag holder system as recited in claim 1, further comprising a stepped shoulder formed on the perimeter edge of the bottom gate and a locking tab formed on the inside perimeter edge of the media bag holder, the stepped shoulder being disposed below the locking tab when the bottom gate is in the locked position.

7. The media bag holder system as recited in claim 1, wherein the plate has a substantially rectangular configuration and has a second passage extending therethrough, the second passage comprising an elongated second slot extending from the outside perimeter edge of the plate toward an interior of the plate, the second slot terminating at an inwardly tapered second neck opening at the interior of the plate that access a second hole extending through the plate.

8. A media bag holder system comprising:

a media bag holder having a floor with a sidewall upstanding therefrom and bounding a chamber, the floor having a top surface and an opposing bottom surface, the top surface extending to an inside perimeter edge that encircles an opening extending through the floor, a support structure being mounted on the bottom surface of the floor and projecting into the opening at a location below the top surface of the floor; and a bottom gate comprising a plate having a top surface and an opposing bottom surface that both extend to an encircling outside perimeter edge, an elongated first slot extending from the outside perimeter edge of the plate toward an interior of the plate, the first slot terminating at an inwardly tapered first neck opening at the interior of the plate that accesses a first hole extending through the plate, the plate being lowered down through the chamber and seated on the support structure so as to be disposed within the opening of the media bag holder.

9. The media bag holder system as recited in claim 8, further comprising a media bag having a tube projecting therefrom, the tube being positioned within the first hole and having an outside diameter that is smaller than the inwardly tapered first neck opening.

10. The media bag holder system as recited in claim 8, further comprising an elongated second slot extending from the outside perimeter edge of the plate toward an interior of the plate, the second slot terminating at an inwardly tapered second neck opening at the interior of the plate that accesses a second hole extending through the plate.

11. The media bag holder system as recited in claim 8, wherein the top surface of the bottom gate is flush with top surface of the floor of the media bag holder.

12. The media bag holder system as recited in claim 8, further comprising a recess formed on the top surface of the plate about the first hole.

13. A method for positioning a media bag comprising:

lowering a bottom gate into a chamber of a media bag holder until the gate is supported within an opening extending through a floor of the media bag holder; passing a tube projecting from a media bag through a slot extending through the bottom gate; and sliding the bottom gate horizontally into a locked position within the opening of the media bag holder so that the bottom gate is precluded from being vertically lifted out of the opening while in the locked position.

14. The method as recited in claim 13, wherein the tube is passed through the slot on the bottom gate when the bottom gate is within chamber of the media bag holder.

15. The method as recited in claim 13, wherein the tube is passed through the slot on the bottom gate prior to inserting the bottom gate into the chamber of the media bag holder.

16. The method as recited in claim 13, wherein the bottom gate comprises a plate having a top surface and an opposing bottom surface that both extend to an encircling perimeter edge, the slot extending from the perimeter edge toward an interior of the plate, the slot terminating at an inwardly tapered neck opening at the interior of the plate that access a first hole extending through the plate, the step of passing the tube comprising advancing the tube along the slot and into the hole by passing the tube through the inwardly tapered neck opening, the tube having an outer diameter that is larger than the inwardly tapered neck opening.

17. A method for positioning a media bag comprising:

lowering a bottom gate into a chamber of a media bag holder until the gate is supported within an opening extending through a floor of the media bag holder, the bottom gate comprising a plate having a top surface and an opposing bottom surface that both extend to an encircling outside perimeter edge, an elongated first slot terminating at an inwardly tapered first neck opening at the interior of the plate that accesses a first hole extending through the plate; and passing a tube projecting from a media bag along the first slot and into the first hole by passing the tube through the inwardly tapered first neck opening, the tube having an outer diameter that is larger than the inwardly tapered first neck opening.

18. The method as recited in claim 17, wherein the tube is passed along the first slot prior to lowering the bottom gate into the chamber of the media bag holder.

19. The method as recited in claim 17, wherein the tube is passed along the first slot after lowering the bottom gate into the chamber of the media bag holder.

* * * * *